US009752385B2

(12) United States Patent
Hay et al.

(10) Patent No.: US 9,752,385 B2
(45) **Date of Patent: *Sep. 5, 2017**

(54) PIPE IN PIPE BHA ELECTRIC DRIVE MOTOR

(75) Inventors: Richard Thomas Hay, Spring, TX (US); Keith E. Holtzman, Arvada, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 372 days.

This patent is subject to a terminal disclaimer.

(21) Appl. No.: 14/371,061

(22) PCT Filed: Jan. 11, 2012

(86) PCT No.: PCT/US2012/020929

§ 371 (c)(1),
(2), (4) Date: Jul. 8, 2014

(87) PCT Pub. No.: WO2013/105952

PCT Pub. Date: Jul. 18, 2013

(65) Prior Publication Data

US 2014/0326509 A1 Nov. 6, 2014

(51) Int. Cl.

| | |
|---|---|
| ***E21B 4/04*** | (2006.01) |
| ***E21B 17/00*** | (2006.01) |
| ***E21B 17/02*** | (2006.01) |

(52) U.S. Cl.
CPC ..... *E21B 4/04* (2013.01); *E21B 17/003* (2013.01); *E21B 17/028* (2013.01)

(58) Field of Classification Search
CPC ..... E21B 4/04; E21B 4/00; E21B 4/02; E21B 4/006; E21B 4/10; E21B 4/12; E21B 4/20; E21B 3/00; E21B 7/067; E21B 7/00; E21B 7/04; E21B 7/06; E21B 17/03; E21B 43/12; E21B 43/128; E21B 17/028
See application file for complete search history.

(56) References Cited

U.S. PATENT DOCUMENTS

| | | | | |
|---|---|---|---|---|
| 4,500,263 | A | 2/1985 | Mohn | |
| 4,690,212 | A | 9/1987 | Termohlen | |
| 4,722,402 | A * | 2/1988 | Weldon | E21B 4/12 175/104 |
| 5,400,430 | A * | 3/1995 | Nenniger | E21B 36/04 166/302 |
| 2011/0036560 | A1 | 2/2011 | Vail et al. | |
| 2013/0098632 | A1* | 4/2013 | Wetzel | E21B 43/128 166/373 |

FOREIGN PATENT DOCUMENTS

| | | | |
|---|---|---|---|
| SU | 710296 | A1 | 10/1993 |

OTHER PUBLICATIONS

Office Action issued in related Russian Application No. 2014132895 mailed on Mar. 31, 2016 (4 pages).
International Search Report and Written Opinion issued in related PCT Application No. PCT/US2012/020929 mailed Sep. 3, 2012, 7 pages.

* cited by examiner

*Primary Examiner* — Wei Wang
(74) *Attorney, Agent, or Firm* — Alan Bryson; Baker Botts L.L.P.

(57) ABSTRACT

A pipe in pipe electric motor assembly comprising: a drilling string comprising an inner pipe and an outer pipe and an electric motor; wherein the electric motor is provided with power supplied by the inner pipe and the outer pipe acting at least as conductors and associated methods.

20 Claims, 14 Drawing Sheets

PIPE IN PIPE BHA ELECTRIC DRIVE MOTOR

CROSS-REFERENCE TO RELATED APPLICATION

This application is a U.S. National Stage Application of International Application No. PCT/US2012/020929 filed Jan. 11, 2012, which is hereby incorporated by reference in its entirety.

BACKGROUND

To produce hydrocarbons (e.g., oil, gas, etc.) from a subterranean formation, wellbores may be drilled that penetrate hydrocarbon-containing portions of the subterranean formation. In traditional drilling systems, rock destruction is carried out via rotary power. This rotary power may be provided to the drill string by rotating the drill string at the surface using a rotary table. This power may also be provided by a top drive or may be provided from mud flow using a mud motor. Through these modes of power provision, traditional bits such as tri-cone, polycrystalline diamond compact ("PDC"), and diamond bits are operated at varying speeds and torques.

When using a mud motor to generate the torque for performing drilling operations, hydraulic losses along the drill string can limit the desired flow rate of mud. This in turn may reduce the hydraulic power one can apply to the mud motor to generate torque. This is especially critical for drilling systems such as Reelwell™ where the flow rates are reduced to levels approaching 30% of conventional flow rates. The dramatic drop in flow rate coupled with greater depths of drilling targeted for this technology may result in higher fluid friction during circulation and thus the need for higher circulating pressures. Such a system may impose serious limitations on the hydraulic power available to the bottom hole assembly in ultra extended reach drilling. Therefore, means of generating downhole torque on the drill bit other than from just hydraulic means via circulation along the drill string are desirable.

In addition, special modifications to positive displacement motors (PDMs) are often required to permit these systems to operate at the lower flow rates. These modifications may involve lowering the fluid volume required to drive the power section per rotation of the mud motor rotor by reducing the volume of fluid per stage section of the mud motor. At these lower flow rates, turbine motors would need to have tighter vane structures with higher blade angles and higher flow velocities across the smaller vanes to operate effectively. This may result in higher flow resistance and a greater risk of erosion from the mud flow for a given operating output torque. It is therefore desirable to develop a drilling system that creates rotational power generated from a device other than a PDM, vane, or turbine motor where hydraulic pressure would be required to generate rotational force to drill the hole.

BRIEF DESCRIPTION OF THE DRAWINGS

Some specific example embodiments of the disclosure may be understood by referring, in part, to the following description and the accompanying drawings.

DETAILED DESCRIPTION

Figure 1:
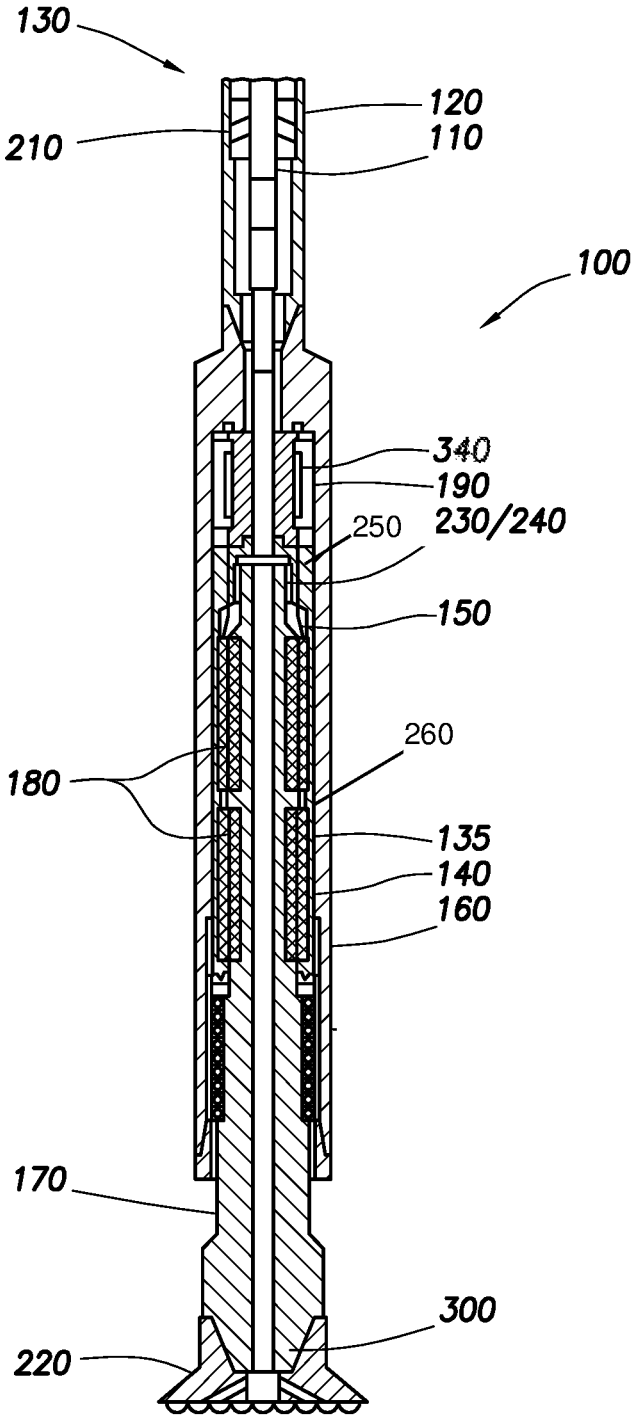
FIG. 1 shows an illustrative layout of a pipe in pipe electric BHA motor.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

In one embodiment, the present disclosure provides a pipe in pipe electric motor assembly comprising a drilling string comprising an inner pipe and an outer pipe and an electric motor, wherein the electric motor is provided with power supplied by the inner pipe and the outer pipe acting at least as conductors.

In another embodiment, the present disclosure provides a method of providing power to an electric motor comprising providing a pipe in pipe electric motor assembly comprising a drilling string comprising an inner pipe and an outer pipe and an electric motor, wherein the electric motor is provided with power supplied by the inner pipe and the outer pipe acting at least as conductors and providing power to the electric motor.

In another embodiment, the present disclosure provides a method of drilling a wellbore in a subterranean formation comprising providing a pipe in pipe electric motor assembly comprising a drilling string comprising an inner pipe and an outer pipe; an electric motor; and a drill bit, wherein the electric motor is provided with power supplied by the inner pipe and the outer pipe acting at least as conductors; providing power to the electric motor to generate rotational power; and applying the rotational power to the drill bit.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores or construction boreholes such as in river crossing applications in any type of subterranean formation. Embodiments may be applicable to injection wells as well as production wells, including hydrocarbon wells.

The terms "couple" or "couples," as used herein are intended to mean either an indirect or direct connection. Thus, if a first device couples to a second device, that connection may be through a direct connection, or through an indirect electrical connection via other devices and connections. The term "uphole" as used herein means along the drillstring or the hole from the distal end towards the surface, and "downhole" as used herein means along the drillstring or the hole from the surface towards the distal end.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface.

The present invention relates generally to well drilling and completion operations and, more particularly, to systems and methods of using electric motors to drive a drill bit.

FIG. 1 depicts an over all layout of the pipe in pipe electric BHA motor assembly (100) in accordance to one embodiment of the present disclosure. As shown in FIG. 1, pipe in pipe electric BHA motor assembly (100) may comprise inner pipe (110), outer pipe (120), work string (130), electric motor (135), stator windings (140), shell carrier (150), motor housing (160), drive shaft (170), drive shaft magnets (180), electric motor controller (190), flow diverter (210), drill bit (220), and high pressure flow restrictor (230). In certain embodiments, power, preferably direct current power, may be transmitted between inner pipe (110) and outer pipe (120) from the surface along the length of work string (130). In certain embodiments, inner pipe (110) may be considered the power hot conductor and outer pipe (120) may be considered the ground. This may be important from a safety stand point to keep outer pipe (120) as the ground, as it may be conductively connected to the drilling rig and it may be difficult to keep insulated in a drilling environment.

Inner pipe (110) and outer pipe (120) may eccentric or concentric. In certain embodiments, the outer surface of inner pipe (110) may be coated with an insulating material to prevent short circuiting of the inner pipe (110) through the mud or other contact points to the outer pipe (120). In other embodiments, the inner surface of outer pipe (120) may be coated with an insulating material. Examples of insulating materials include dielectric materials. Suitable examples of dielectric materials include polyimide, a GORE™ high strength toughened fluoropolymer, nylon, TEFLON™, and ceramic coatings. In certain embodiments, only in areas sealed and protected from the drilling fluid is the bare metal of inner pipe (110) exposed to make electrical connections along the length of work string (130) to the next joint of inner pipe. Such areas may be filled with air or a non-electrically conducting fluid like oil or a conductive fluid such as water based drilling fluids so long as there is not a path for the electric current to flow from the inner pipe to the outer pipe in a short circuit manner.

In certain embodiments, stator windings (140) may be mounted in a pie wedge fashion within shell carrier (150). In certain embodiments, shell carrier (150) may be fixed within the motor housing (160) to prevent the carrier from rotating relative to the work string (130).

In certain embodiments, drive shaft magnets (180) may comprise fixed permanent magnets mounted on drive shaft (170) in such a manner as to encourage reactive torque from the varying magnetic poles created by the stator windings (140). In certain embodiments, electric motor (135) may comprise a 6 pole motor. Several variations in the number of poles and the decision on whether to couple the magnets to the drive shaft verses the housing exists as well as other forms of electric motors such as direct drive motors with a mechanical commutator drive winding arrangement and squirrel cage induction motors that do not use permanent magnets. Single phase motors are possible with the assistance of capacitors to create a pseudo second phase.

In certain embodiments, electric motor controller (190) may be positioned above the stator windings (140) to control various aspects of electric motor (135). Electric motor controller (190) can communicate in both directions with the surface through the two conductor path formed by inner pipe (110) and outer pipe (120) and through a feed through wire or wires that feed through the electric motor assembly to modules positioned below the motor such as LWD and/or MWD and steering systems.

In certain embodiments, electric motor controller (190) may be housed inside a pressure controlled cavity to protect the electronics. The electric motor controller (190) electronics may be coated with a ceramic coating to allow for the cavity to be oil filled and pressure balanced with the annulus allowing for a thinner wall to house the electronics. Advantages of filling the cavity with oil and pressure balancing with the annulus are that the wall thickness to of the electronics cavity to be maintained in a much smaller thickness since it does not have to hold back the entire pressure of the fluid column leaving more space available for the electronics and providing for better heat conduction of heat generated by the electronics to keep it within operable limits.

In certain embodiments, stator windings (140) may be encapsulated in a ceramic, rubber, or epoxy like potting. This allows the encapsulated region additional short circuit protection that would normally be relegated to the typically peek coating found on the magnet wire which can then be exposed to mud which part of the mud circulates through this region to provide cooling for the windings and power electronics as well as lubricate the mud bearings and radial bearings along the drive shaft (170).

During operation of pipe in pipe electric BHA motor assembly (100), mud may flow down annular spaces formed by inner pipe (110) and outer pipe (120). Mud and cuttings may be returned to the surface inside inner pipe (110). However, near the top of electric motor (135) this flow regime may change slightly. Flow diverters (210), which are electrically insulated from the outer drill pipe and preferably made of ceramic or metallic with a dielectric insulating coating on the outer surface, allow mud and cuttings from the annulus formed by inner pipe (110) and outer pipe (120) to enter the inner pipe while passing downward flowing mud through kidney shaped slots in flow diverter (210). Below this point, downward flowing mud may be diverted into a center bore where it passes through the inner pipe (110) electrical connection to the electric motor (135) into the motor housing (160). At this point the downward flowing mud may take two separate paths. The first path is down the center bore of drive shaft (170) and down to drill bit (220) at the bottom of the work string (130) where it exits drill bit (220) and begins its way back up the hole to the flow diverter inlet ports. The other path is through a high pressure flow restrictor (230) at the top of drive shaft (170) then through the space between the outer portion of the rotor and the inner portion of the motor housing and out through the bottom radial bearing assembly just above the shaft bit connection on the bottom of the motor housing. High pressure flow restrictor (230) may be designed to leak a certain amount of drilling fluid to flow through into the motor housing (160) to cool the stator windings (140) and to lubricate the radial and axial bearings of the electric motor (135). The high pressure flow restrictor (230) may also double as a radial bearing (240). In other embodiments, a separate radial bearing (240) may exist. Radial bearings (240) may comprise rubber marine bearings, PDC bearings or various hardened coatings like fused tungsten carbide.

High pressure flow restrictor (230) may be positioned anywhere along the either flow path as long as the flow is restricted somewhere along the path of the top of the drive shaft and the bottom of the motor housing. In certain embodiments, high pressure flow restrictor (230) may be positioned directly below the upper radial bearings (240) as it is easier to work with such a device and it also acts as a filter keeping larger solids that happen to get into the mud away from the stator windings (140) and radial bearings (240).

Figure 2:
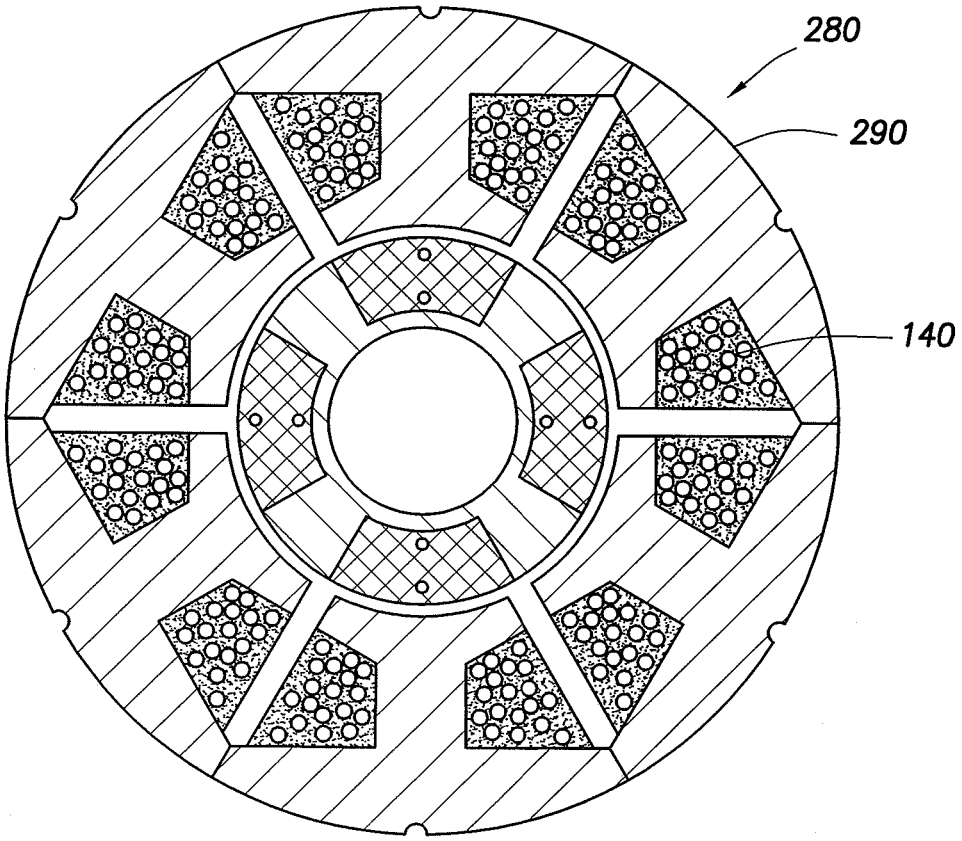
FIG. 2 shows an illustrative cross section of rotor and stator of the electric motor.

FIG. 2 depicts a cross section of rotor and stator without the winding carrier sleeve (250) or motor housing (160). In this example, a 6 pole stator winding assembly (280) is shown. The stator windings (140) may wrap along one or more stator heads (290). In certain embodiments, the one or more stator heads (290) may comprise long rectangular pie wedges. The one or more stator heads (290) may be made of a soft iron with a high permeability. Ideally the one or more stator heads (290) may contact each other or may be welded together.

In other embodiments, a stator head assembly may be made out of one round bar by using machining methods like electrochemical machining, wire EDM, or electrode electrostatic disgorge machine machining or even extruding the shape so that the outer diameter of stator head assembly is one solid diameter rather than 6 individual pieces. Since it may be more expensive to make the stator heads out of one bar, ideally the stator winding assembly (280) is made up of 6 pieces to reduce manufacturing costs. In the case where the stator heads are made out of one bar, the stator windings would have to be threaded through the various passages. While this may be difficult, the encapsulated coating could be injection molded into the inner area and ends. It would be desirable to still coat the stator to reduce corrosion and increase its useful life but in this case the potting material could suffice for this role. In certain embodiments, the potting material can be made of various compounds such as epoxy, ceramic based compounds, nylon or peek like polytetrafluoroethylene such as Arlon 100 from Greentweed.

In the pie wedge concept illustrated in FIG. 2, the stator heads may corrode when exposed to many types of mud systems if the pie wedge contact area near the outer diameter is not coated with a protective material. However for a very minor trade off in power efficiency, a very thin corrosive resistant coating may be applied to the stator heads at the outer diameter points of contact to limit magnetic flux linkage losses while applying a heavier coating to the parts of the stator head exposed to flowing mud.

The stator windings (140) may be varnish, peek or other dielectric type coated magnetic wire ideally made of silver, copper, aluminum, or any conductive element, including high temperature super conductor materials. The stator windings (140) may make several wraps around the stator heads (290). Optionally, over top and embedded into the stator windings (140) may be a potting material, preferably a ceramic or more flexible high temperature epoxy. This material may be used to protect the stator windings (140) from corrosion from the mud and erosion protection, especially from fine sands that can make their way into this area.

The one or more stator heads (290) may be grooved on the outer diameter and may be keyed with the shell carrier (150) to hold the one or more stator heads (290) still from the torque generated. This torque may then carried to the motor housing (160) through additional spline grooves in the carrier housing (260) and the splines on the motor housing (160). Other ways of doing this are easy to understand by those skilled in the art.

Optionally the carrier housing (260) outer diameter and the motor housing (160) inner diameter may be slightly tapered, narrowing toward the top, to allow for a snug fit and prevent mud fines from building up between the motor housing (160) and the carrier housing (260). In this manner the winding carrier sleeve (250) may be pulled or pressed out. The top of the winding carrier sleeve (250) may have additional anti-rotation keys that engage the electronics insert and/or the additional spline grooves that engage the splines located in the motor housing (160).

Figure 3:
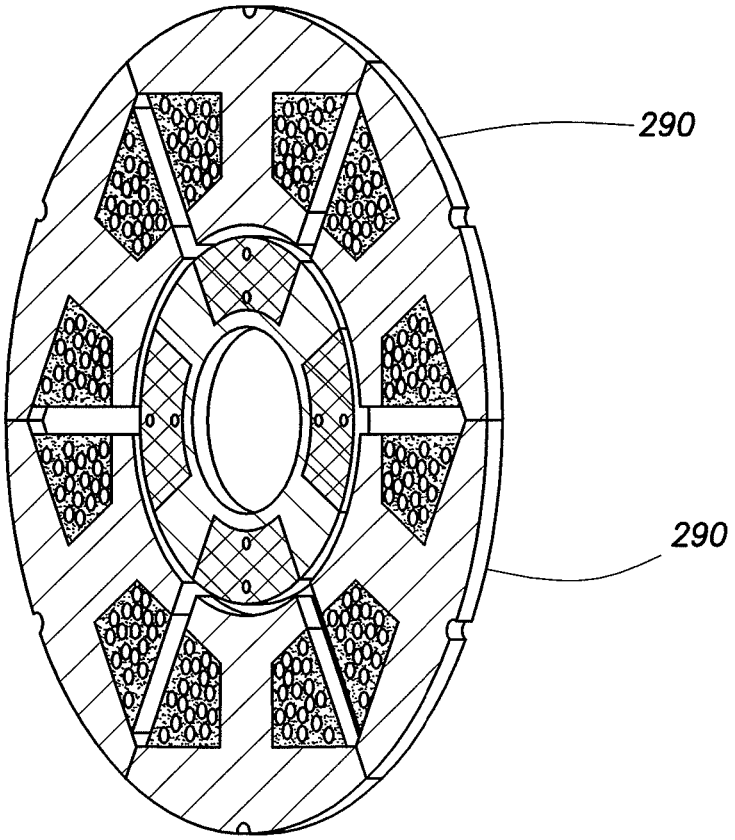
FIG. 3 shows an illustrative cross section slice of a stator and rotor.

In certain embodiments, the one or more stator heads (290) may be made with thin slices of the cross section shown FIG. 3. As shown in FIG. 3, the shape of the one or more stator heads (290) may be stamped from thin sheets of iron, coated with a thin insulated and stacked one on top of each other in the carrier then threaded with the winding. This is because long solid bars of the one or more stator heads (290) along the length of the electric motor (135) would create large eddy currents that would greatly hamper motor efficiency and create heat. The wires extend along the length of the stator head slices uninterrupted winding around the group of stator head slices.

By using thin stamped sheets, the problems mentioned above with manufacturing costs and assembly issues may be solved while still providing for a power stator design. The thickness of each stator slice would require some modeling to optimize but a thickness of 1/16"-1/4" is a typical range. Alternately each individual stator head can be stamped out thus needing 6 stamped pieces to make 1 layer and arranged as shown in FIG. 2.

Referring now back to FIG. 1, drive shaft (170) may run out the bottom of the electric motor (135) to thread into either a drill bit (220) or other BHA components. While pin end connection (300) on drive shaft is shown in FIG. 1, a box connection could replace pin end connection (300). On drive shaft (170), one or more drive shaft magnets (180) may be mounted. FIG. 1 depicts four drive shaft magnets (180) mounted on drive shaft (170). While there are other ways of making a rotor for an electric motor, such as a squirrel cage induction motor, this method of permanent magnets offers a great deal of torque delivery and mechanical stability. The drive shaft magnets (180) may be arranged to be optimized for a 3-phase motor. Those skilled in the art of 3 phase motors will easily recognize how this motor operates by pushing and pulling the shaft magnets with the electromotive force of the stator by varying the phase of the current passing through the 6 windings. At higher temperatures of operations, windings would have to be used instead of magnets on the drive shaft to facilitate torque transfer much like a squirrel cage motor. The primary limit of magnets is the curie temperature where the magnetization of the magnet is lost or at least a significant reduction in the pole strength of the magnet occurs.

An advantage of this type of motor is that it can be controlled with solid state switches rather than using a commutator. While a commutator would work it is not ideal as it must use brushes in an electrically insulated environment, which would mean an oil filled cavity with a rotary seal for a barrier to the mud would be necessary which can be problematic for reliability and maintenance reasons if the rotary seal has to operate at high RPMs over long hours as is the case here.

Referring again back to FIG. 1, pipe in pipe electric BHA motor assembly (100) may further comprise electronics insert (340). Electronics insert (340) ideally has a processor with memory for monitoring, and controlling the electric motor (135). The processor provides several functions, including but not limited to motor start up control, capacitors to aid start up and operation, power consumption monitoring, motor speed control (which is managed mostly through the frequency applied to the windings and the current allowed to flow in those windings), motor toque output control (constant or variable torque delivery), power control, motor temperature control (the stator windings may be embedded with temperature sensors), transmission of motor and BHA sensor data to the surface through the pipe in pipe conductors, receipt of motor parameter commands such as speed, torque, power output limits etc, data, queries for data and other forms of requests from surface over the pipe in pipe conductors, stall detection and recovery, slip stick detection and a closed loop response to managing the stick slip to maintain the motor drilling conditions in a more favorable range. The system automatically detects and stays away from bad drilling parameters and learns what they are as drilling proceeds. The self learning feature specifically addresses detection of stalling conditions and limits power delivery to the windings essentially shutting down the motor if the applied force on the motor and the subsequent drop in shaft RPM results in a threshold for stalling the motor or operating the motor at too low of a speed which could potentially cause damage to the motor windings by having too much current circulating through them. The processor would get weight and torque data from surface or a down hole sensor either in the motor or embedded elsewhere in the drill string such as in the bottom hole assembly MWD system or a sensor located further up in the drill string. This essentially would allow the processor to power down the motor prior to or at damaging stall rotation rates being achieved then restart the motor with either short test durations to determine if the applied load has been relieved and/or further sensor information from the weight and torque sensors indicating it safe to operate. Further to that, the electronics can contain current limiting circuits so as to limit the amount of current that can be applied to the motor winding coils so as to avoid damaging currents from circulating in the windings. The processor can record and monitor RPM verses applied power along with weight on bit and torque to sense if there is a degradation in motor orbit performance occurring overtime and notify the surface computer and operators of this condition. For example if the applied power to the motor remains constant but the torque applied to the formation is detected as being less than what was observed at a prior point in time, it may indicate a degradation in the bit or motor performance. It may also be a function of the formation properties being drilled. As such data is relayed to surface over the telemetry system so it can be studied in real-time and acted upon if necessary. Such data could be used for example to calculate the mechanical efficiency of the drill bit to monitor it for signs of wear. The mechanical efficiency and or the torque and weight data can be compared against the earth model from offset wells in the area to determine the optimal weight applied to the bit and the required torque from the electric motor to get preferred drilling performance for the formation being drilled in.

There are many ways to create 3-phase power from a direct current (DC) power source. A DC power source from surface or another power generation source down hole is ideal if the power has to be transmitted over great distances since the conductive mud between the inner and outer pipe creates losses in an alternating current (AC) power transmission scenario. Often power transmission lines that traverse water, especially salt water, utilize direct current in order to minimize electromagnetic radiation losses into the water surrounding the power transmission cable. Likewise in a subterranean formation there exists intervals from time to time that have a high conductivity capacity which would enhance the power losses along the pipe in pipe power transmission circuit for changes in flowing current along the pipe in pipe system. So it is a benefit to minimize current fluctuations as much as possible by utilizing a direct current rather than an alternating current to power the electric motor. That said one could use any form of electric power to drive the motor. In certain embodiments, DC power may be desirable as it may allow for easier power control of certain circuits downhole. Ideally one would want 3-phase power transmitted from surface to the motor downhole but this would mean more conductors would be required in the pipe in pipe system and this would reduce reliability and increase complexity of the pipe in pipe system to include at least 1 more conductor and realistically a 4th as a ground return would be desirable but not essential.

Figure 4:
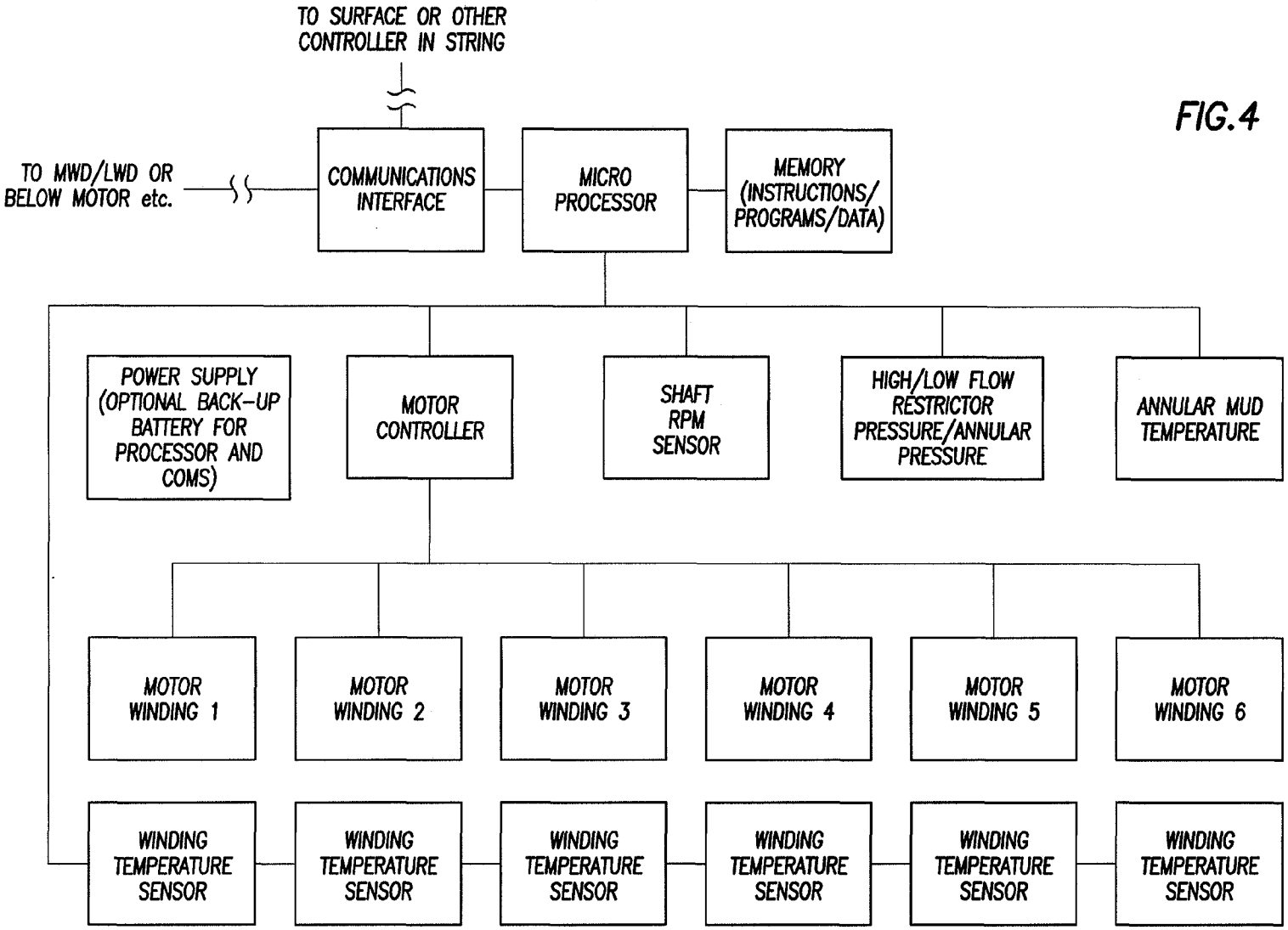
FIG. 4 shows a block diagram of motor electronics.

A generalized block diagram is shown in FIG. 4, which details the communications, sensors, and motor control elements of the system. While not shown in FIG. 4, there could also be communications through the bottom of the motor or both up and downward directions in the string. Such means would be through the use of slip rings or inductive couplings and are known to those skilled in the art. The slip ring or inductive coupling allows the communication and/or power to jump in either direction between the motor housing and the rotating drive shaft. End point connectors with electrical conductors provide a signal path way to the motor top or bottom where communications can continue onto the next module. Ideally the connection on the top of the motor is through a communications interface that couples into the power delivery of the 2 pipe conductor.

In certain embodiments, the communications channel can be in direct communications with the pipe in pipe communications network or it could be communicating with a local network such as one for an MWD/LWD system or a near bit or in bit communications node or a plurality of networks and communication nodes. The processor may execute commands that are stored in a memory storage area which could be embedded in the processor itself or in separate memory elements such is memory chips like RAM or Flash RAM or a solid state hard drive or other forms of memory storage/retention devices. The memory may also used for logging performance information about the motor such as winding temperature, tool temperature, mud temperature, shaft RPM, power output, torque output, system current, voltage and power, winding current, voltage and power input, and pressure on either side of the high pressure flow restrictor to watch for signs of wash out and make sure mud is flowing through the windings to keep them cool from heat generated by resistance in the windings and bearing friction primarily. The power supply supplies power from the pipe in pipe conductors. Since the pipe in pipe conductors may be used to power everything, no connected lines are shown in FIG. 4. The pressure sensors can also be used to inhibit operation of the motor in the absence of flow detection so as to protect the motor from over heating.

In addition batteries, rechargeable batteries, or a capacitor may be used to provide minimal power to the communications, sensors, processor and memory modules and any other desired electronic device in the tool should the power to drive the motor shut off. In this manner low power communications with the motor can continue even if there is not enough power to power the motor's electrical windings sufficiently to drill the hole. This would allow the system to stay responsive to communications and other electronic functions, such as logging data from sensors, while a connection is being made for example where maintaining power to the down hole motor is easily done is a safe manner when adding a new pipe to the string.

The use of batteries may also allow for communications and sensors to be kept alive so data exchange and commands can be performed while a connection is being made on surface or another rig operation is taking place so long as a surface connection for communications is set up and maintained. In addition communication between various network nodes in the work string may still maintained so that sensors can be monitored even if surface communications is down thus logging important data. This is especially useful when tripping out of the hole and wanting to log certain areas on the way out.

DC power may be converted to 3-phase current by the motor controller. The motor controller preferably uses solid state electronics for switching on current to windings and flipping the polarity of those windings in a manner to replicate 3-phase power from surface. Current to the 6 windings is managed in 3 pairs where the current in any pair is nearly the same at any given moment of time save for minor lag effects. The winding pairs may be opposite to each other in the motor as shown in FIG. 2 with the phase relationship shown in FIG. 5 with each pair being 120° out of phase with any adjacent winding pair.

Figure 5:
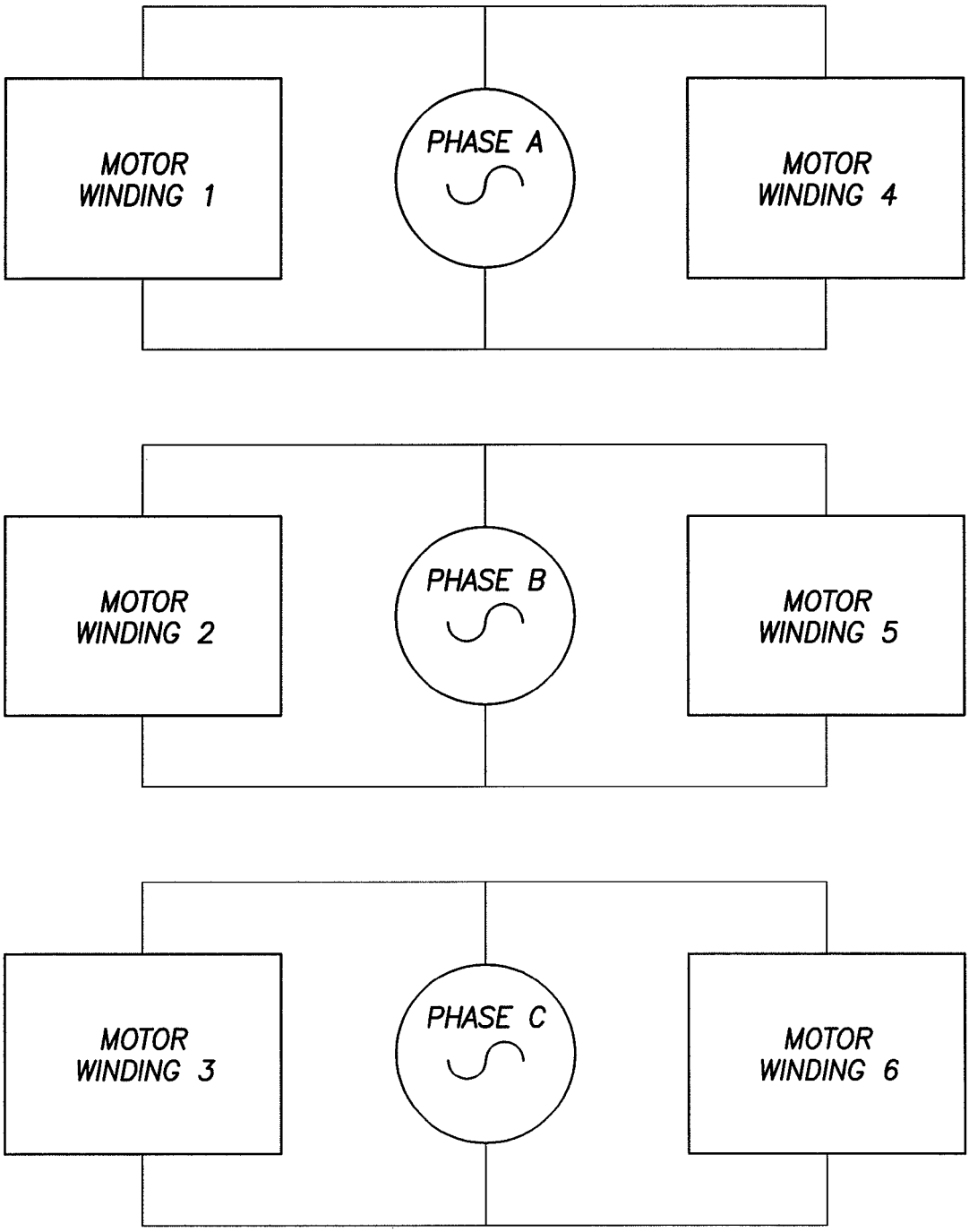
FIG. 5 shows a block diagram of winding pairs.

The phase relationships between the 3 phases may controlled by a master controller that ensures all 3 phases remain in frequency sync but 120° of separation in phase. In order to maximize power transfer to the rotor, a sinusoidal or other wave shape for the 3 phase controller may be generated to power the 3 pairs of windings. Each winding may be preferably connected in parallel, rather than in series, to reduce series resistance of the winding pairs. The windings and current flow may be timed such that each stator pole has the same orientation as its other pair. This means that the inner tip of each stator pole pair may have the same magnetic field polarity such as North, South or neutral. In embodiments where each coils is wrapped identically for each winding, each phase pair may be wired in parallel as shown in FIG. 5.

Critical functions of the motor controller may include: (1) switch polarity directions in sync with the desired rotation direction; (2) maintain phase separation of each winding pair; (3) maintain the applied frequency and ramp the frequency up and down at acceptable rates for the motor based on changes in desired motor speed; and (4) maintain power levels to the windings to optimize torque delivery for the desired speed. Each of these functions may be accomplished by varying the supplied current or voltage, or both, to the winding pairs and/or varying the duty cycle of each wave. Alternatively, or in addition to, start up capacitors can be employed to aid the motor in ramping up in speed. These capacitors are generally switched out by the motor controller as the motor reaches about 75% of its rated speed.

It should be noted that in some embodiments, the controller may simply alter the phase of any two channels (A and B, B and C, or C and A) to change the direction of rotation of the rotor while still being able to output the same amount of torque and power to the bit. This may be significant improvement over traditional PDM motors where they can only rotate in one direction. The ability to backward rotate may have many benefits such as helping to get unstuck, undoing a rotary connection to leave a stuck fish in the hole and release the BHA, activating some other mechanical mechanism, drilling in the opposite direction using bit cutters pointing in the opposite direction, or extending a roller cone bit's life by stressing it in the opposite direction.

The motor controller may vary the power to each winding pair in a square wave or sinusoidal fashion or other cyclical wave form method such as a triangle or sawtooth wave form. In certain embodiments, a sinusoidal wave may be preferred as it is the most power efficient. Further a person of ordinary skill in the art could appreciate using varying duty cycles of each wave form to adjust overall average power delivered. In certain embodiments, the electronics may be designed with solid state switches such as variacs or relays to vary the direction of current flow through the windings from the DC source.

Figure 6:
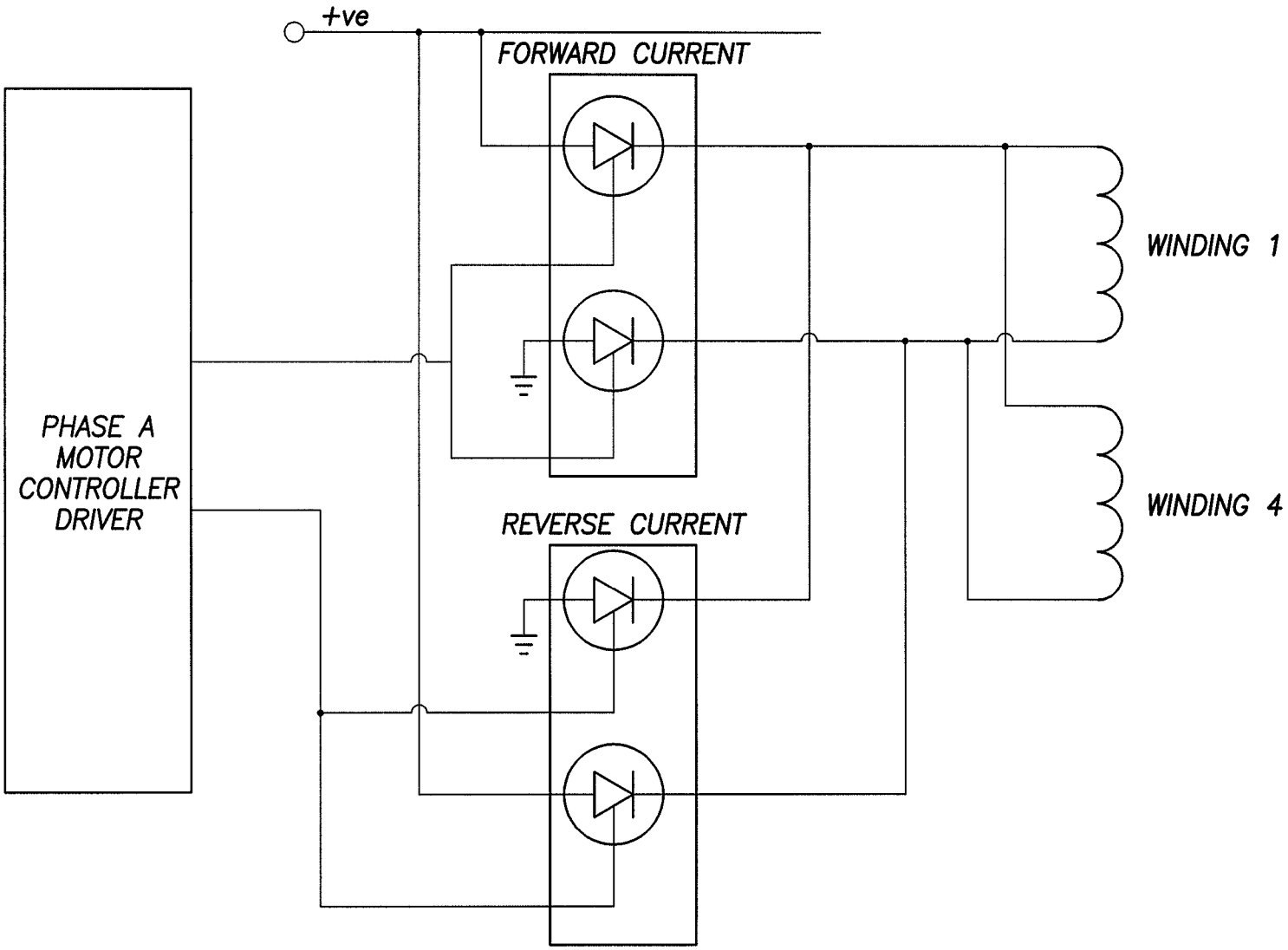
FIG. 6 shows an illustration of an electronics schematic.

In one embodiment, a time varying signal may be emulated to engage the windings with square wave electrical pulses in opposite polarities. By adjusting the phase and duty cycle of each square wave, the average power consumed by the motor per rotation may be varied respectively. Such a method may be accomplished using semi-conductor based switches such as silicon controlled rectifiers (SCR), thyristors or other forms of switching devices. Other methods may include transformers for varying the power applied to the motor windings. Such transformers could include variacs, step up or step down or multi-tap transformers. FIG. 6 shows an arrangement where switches are fired on and off by the controller to vary both the polarity and duty cycle of power applied to each winding pair. A timer in the microprocessor in the motor controller may maintain the pulse width and phase of all 3 channels and ramps up or down the overall frequency as desired. The arrangement depicted in FIG. 6 may also be replicated for the other 2 winding pairs. The motor controller can receive commands from surface or ideally from the local processor with memory that is managing all the other functions of the motor. The instructions and or control parameters in memory can also be programmed over a downlink communications channel while the motor is still down hole if desired.

The motor driver may be a small power amplifier switch used to source enough power to turn the semi-conductor switch on and off and may also switch on or off based on logic outputs from the processor. In certain embodiments where the processor has the power to turn on and off the switches, the digital outputs or analogue outputs of the process can be attached directly to the switch control lines. Essentially the process switches between either switch pair to reverse the current through the winding pair or switches both switch pairs off when the phasing and duty cycle time deems it so.

Returning back to FIG. 1, drive shaft magnets (180) may ideally be of a very high magnetic field strength. Suitable types of drive shaft magnets (180) may include Samarium Cobalt magnets. In certain embodiments, drive shaft magnets (180) may be manufactured in a wedge shaped mold to match a pocket(s) on drive shaft (170). In certain embodiments, drive shaft magnets (180) may be made by pouring into a mold a loose powder of fine particles which is then pressed and sintered in the mold. A weak magnetic field may be applied during this process to align the magnet poles across the thickness of the long bar to the optimal magnetic field orientation for application. While the shape of the magnet may be semi-wedged shaped, alternate shapes such as a rectangle, triangles etc, could be used or just about any variation in geometry. Ideally though the preferred method is to create retention undercuts in the shaft to retain the magnets and sinter the powder on the shaft to essentially couple the magnet to the shaft during the creation of the magnet. Once the drive shaft magnets (180) are set, they may be fastened into the drive shaft (170), if not sintered in place, through various means such as retainer bands/sleeves, screws slots or other fasteners.

The polarity of the drive shaft magnets (180) may be alternated with the North pole (N) facing out then the next magnet polarized or oriented with the South pole (S) facing out, then North again and lastly South for the four pole rotor example. A person of ordinary skill in the art would realize that the number of windings and magnets can be multiplied such as 12 stator poles and 8 rotor magnets or three stator poles and two rotor magnets. The variations will depend upon many factors but this arrangement is a good one for task at hand in trading off reliability for smoother torque delivery while ensuring the peak torque required is maintained for the motor design.

Figure 7A:
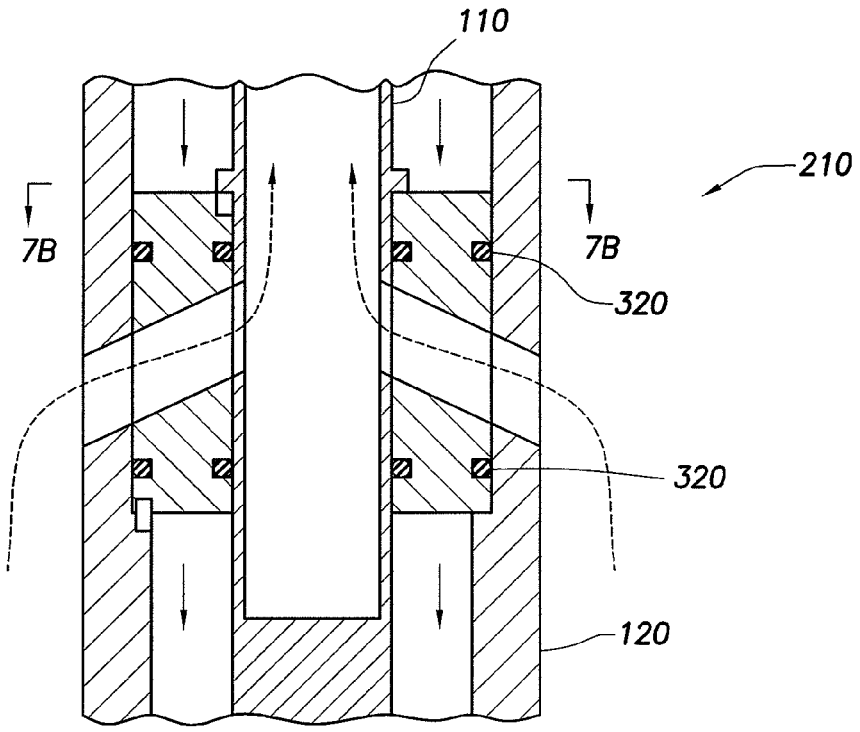
FIG. 7 shows an illustrative layout of a flow diverter within a pipe in pipe system.
Figure 7B:
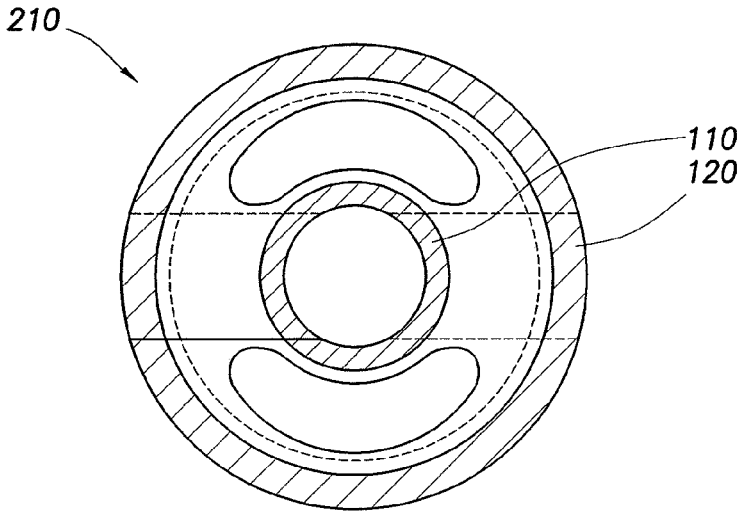

Referring now to FIGS. 7*a* and 7*b*, FIGS. 7*a* and 7*b* show a zoomed in view of the upper portion of FIG. 1. In certain embodiments, flow diverter (210) may be made of preferably an electrically insulating material, such as a ceramic. Ceramics offer a high erosion resistance to flowing sand, cuttings, junk and other solids flowing from the annulus to the inner bore of the inner pipe on the flow return path to surface. Ceramics made by companies like Carboceramics have several useful materials and molding techniques that would make this type of diverter work well out of ceramic material. In certain embodiments, the flow diverter (210) may be a diverter ring. In certain embodiments, the diverter ring does not have to be ceramic so long as the inner pipe is insulated from any conductive material used for the diverter. Alternately the diverter ring could be made of other non-conducting materials as well. Seals (320) may be located on the top and bottom of flow diverter (210) to prevent annular flow between the inner pipe (110) and the outer pipe (120) from leaking into the center of inner pipe (110). As mentioned above, annular flow may come down from surface and pass through the kidney shaped slots in the flow diverter (210) and pass onward down through to the motor area and eventually the end of the drill string. In certain embodiments, flow diverter (210) may be keyed to inner pipe (110) and outer pipe (120) so it can maintain orientation with the holes in inner pipe (110) and outer pipe (120) and prevents it from rotating accidentally.

Figure 8:
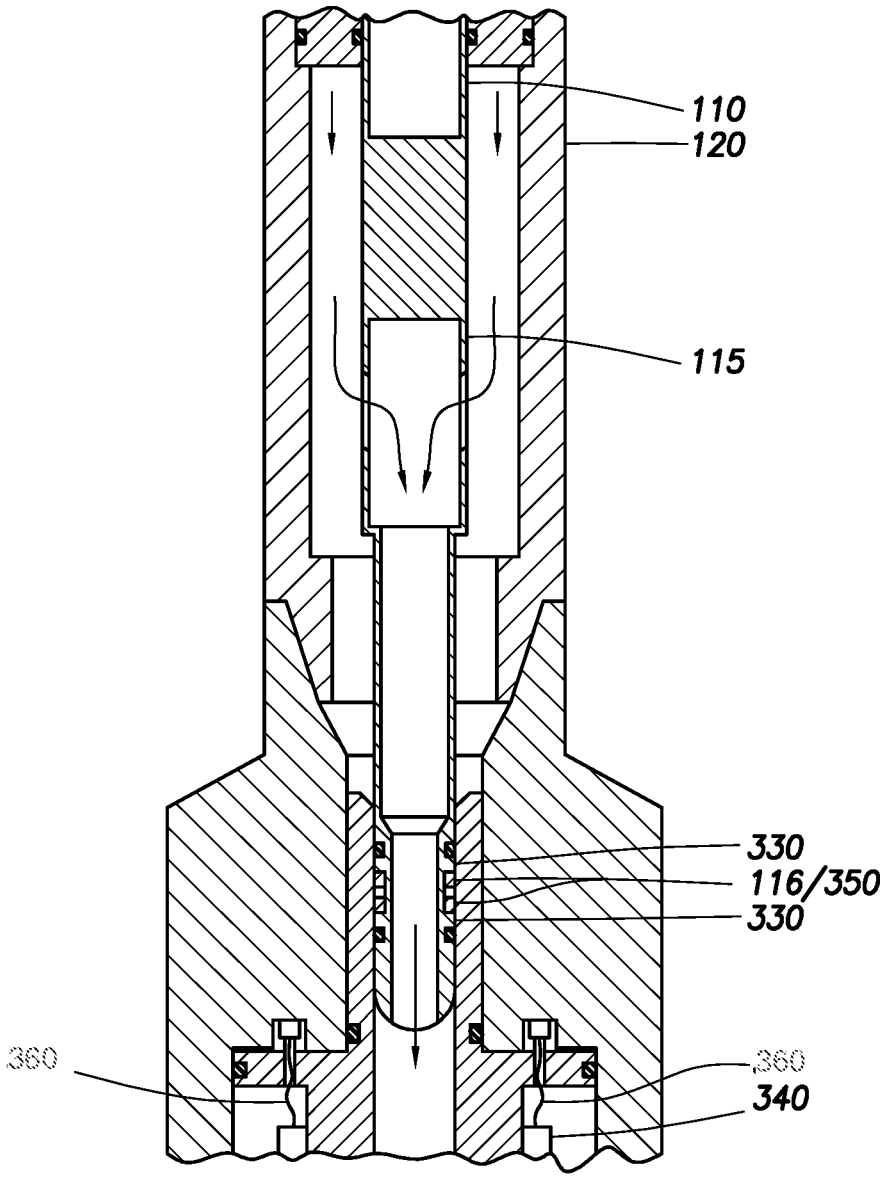
FIG. 8 shows an illustrative layout of a pipe in pipe electric BHA motor.

FIG. 8 depicts how the flow between inner pipe (110) and outer pipe (120) is diverted into the inside of inner pipe (110) inner pipe to section of pipe (115) that does not communicate with the other section of the inner pipe (110). This allows the flow to divert downward down the center of section of pipe (115) to the BHA and out the drill bit. In some embodiments, inner pipe (110) may have an electrically insulated coating in all places except now for an area (116). In this area (116) there is a short section that has an exposed metal section of the inner pipe (110) that mates with an electronics insert (340) of FIG. 1 to facilitate the transfer of electrical power to the electric motor controller (190). The electronics insert (340) may be electrically insulated with a coating except with the exposed section. Conductive wire wound spring (350) may be used to encourage connection in sealed wet connect area (330). The electronics insert (340) may have 2 ground lines (360) that return the electrical path to the outer pipe (120) once the current has passed through the various electronic and motor components. While not shown, the flange end of the electronics insert (340) may have orientation dowels and extra dowels to brace it against any torsional forces it may experience or other mechanical means of retention to prevent rotation. There are several other means of routing power from the inner pipe (110) to the electric motor controller (190) however this method here is considered exemplary in the manner of how it could be done. The ground connections of grounds lines (360) may be sealed from the mud to ensure the connectors do not become damaged from corrosive mud conditions. The mud may flow down the center of the electronics insert (340) and up on the outside of the motor housing now.

Figure 9:
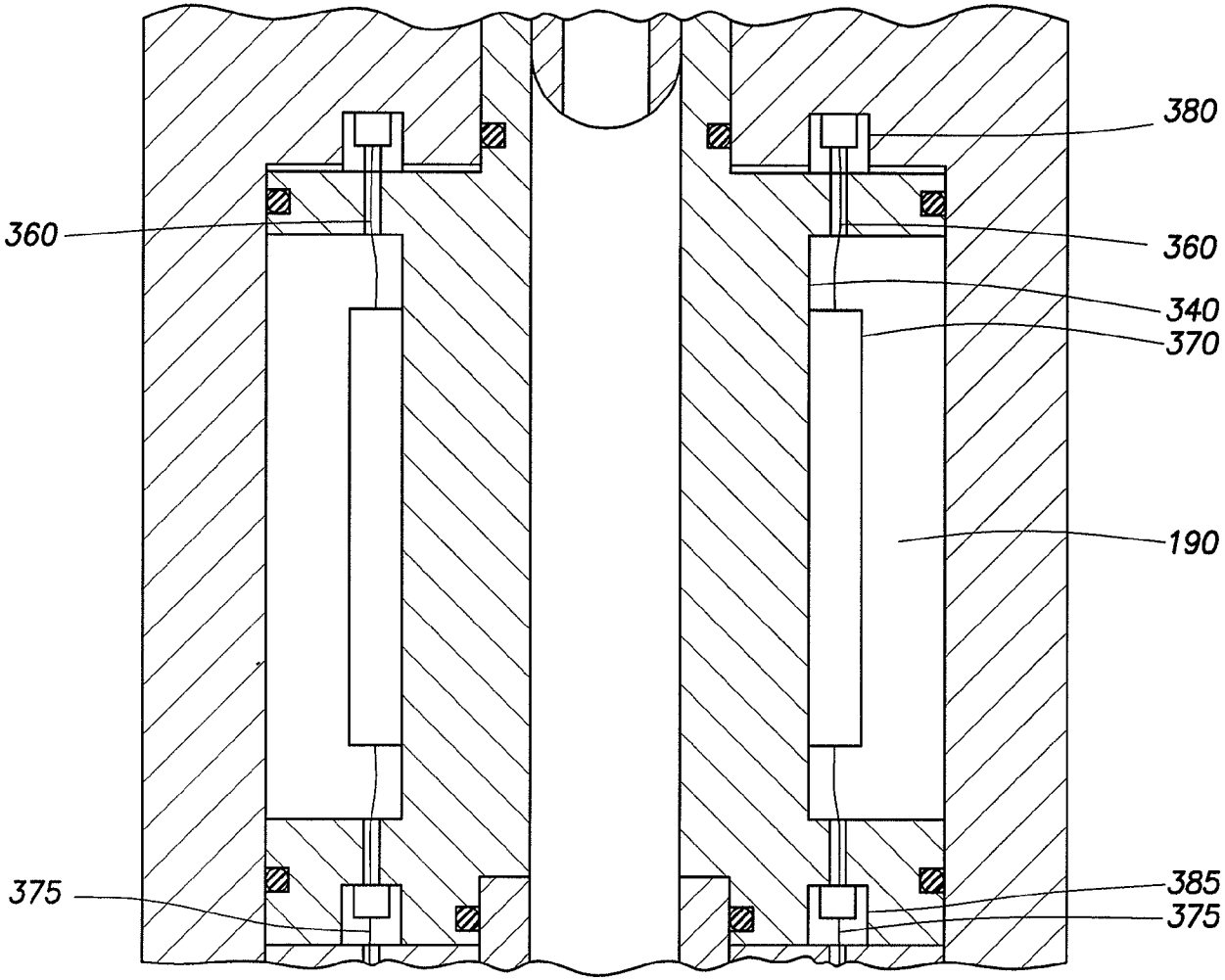
FIG. 9 shows an illustrative layout of an electronics insert.

FIG. 9 depicts the electronics insert (340). As mentioned above, electronics insert (340) may house the processor(s) and power control electronics (370) to control the electric motor. Wires (375) through sealed bulkhead interfaces (380) lead out to the stator windings and sensors (385) below.

Figure 10:
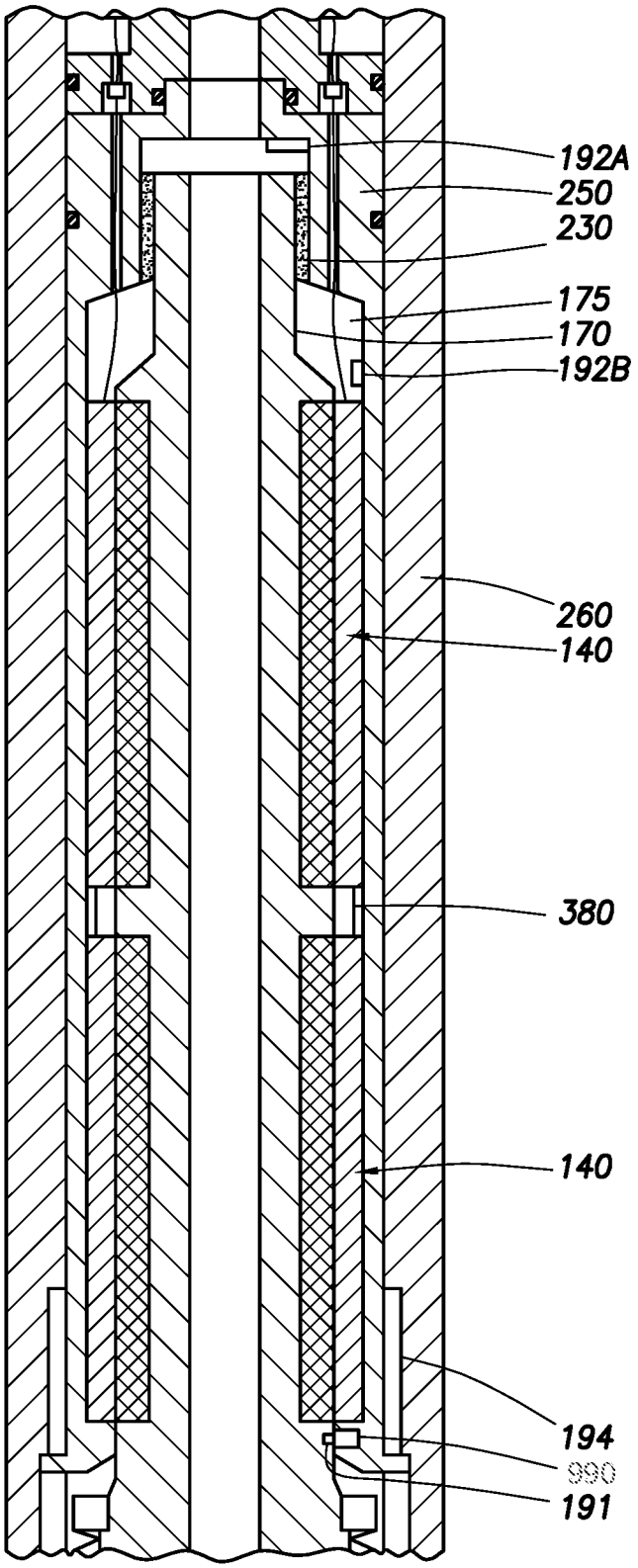
FIG. 10 shows an illustrative layout of a pipe in pipe electric BHA motor.

FIG. 10 shows a number of elements but this is essentially the primary motor winding and drive shaft area. At the top, a high pressure flow restrictor (230), which may double as a radial bearing and has a small gap flow path in it to allow for mud flow through it, may preferably be located. It is generally made of high erosion resistant material such as tungsten carbide or a cobalt based allow like Stellite. Other variations of this combination are possible but the primary purpose here is to allow some mud to leak into the out side of drive shaft (170) to pressure balance the winding area (175) and flow mud through the windings to keep them cool. As depicted in FIG. 10, there may be two sections of stator windings (140) but a single winding section or a plurality of winding sections can be used to optimize the desired torque.

In certain embodiments, hall effect switches (990) may be embedded in winding carrier to monitor shaft position and RPM by observing small magnets (191) or the rotor magnet relative position on the shaft. The signal output of the hall effect switch or other type of rpm sensor is routed back to the motor control electronics where the processor can automatically measure and adjust the speed of the motor based on the sensor feedback. Other types of position sensors may also be included in the winding carrier such as proximity sensors. By monitoring the shaft position while it rotates, one can better optimize the torque delivery to the motor and watch out for pole slippage which can occur if the torque from the bit reaction of drilling exceeds the stall point off the motor or chatter which might mean one winding is applying more torque than another winding in an uneven manner and thus adjust the applied torque output of the windings to obtain as even a torque output as possible. In certain embodiments, temperature sensors may also be embedded in the carrier or adjacent to the windings. Preferably at least one temperature sensor for each winding may be used to monitor the motor temperature. Furthermore, in certain embodiments, a pressure sensor may be installed in the carrier above (192A) and below (192B) the high pressure flow restrictor (230) to monitor the performance of the flow restrictor and make sure a wash out or a plugging is not occurring and to confirm that the mud pumps are indeed on to ensure cooling of the motor.

Between the two winding and drive shaft winding sections, an optional radial bearing support (380), which may be mud lubricated, is located. An elastomeric marine bearing, roller, ball, journal or other bearing style may also be used. The stator winding carrier has spline grooves (194) to mate with motor housing splines to keep the winding carrier from rotating.

Figure 11:
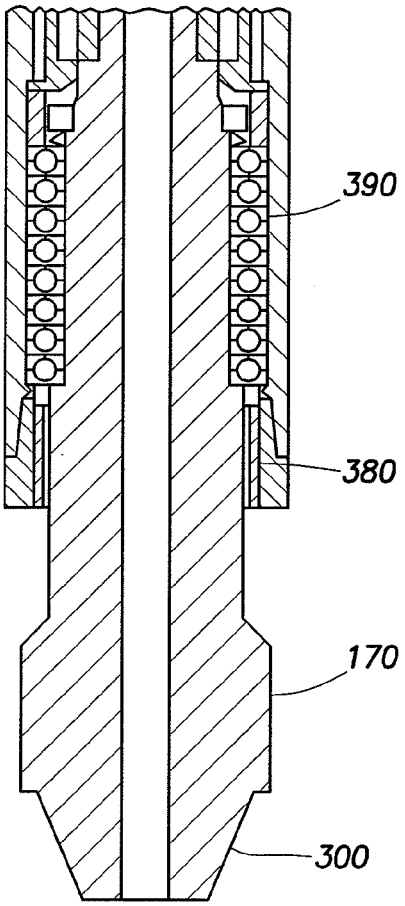
FIG. 11 shows an illustrative lay out of a bearing pack

Referring now to FIG. 11, FIG. 11 illustrates an axial load bearing pack configuration that allows for on and off bottom rotation of drive shaft (170) and has a radial bearing support (380) at the bottom. The drive shaft (170) may have a pin end connection (300) or a box connection. Other variations of this downhole electric motor are possible. For example, the drive shaft (170) may be split into two sections where a torsion rod or universal coupling connects the two shafts through an adjustable or fixed bent housing. The bearing pack may reside above or below the bend, or even above the motor section. An adjustable bent housing can be surface or downhole adjustable meaning it can adjust the tilt angle of the lower end of the drive shaft way from the axis of the tool to at least one angular position and generally a plurality of different angular positions. Preferably, thrust bearings (390) may reside above any bent sub assembly.

In certain embodiments, the electric motor may have an interface module which facilitates coupling, communication, and power transmission continuity to the surface with the drill pipe. The electric motor can be controlled from and respond to surface communications. The electric motor may have variable speed and torque capability. A gear reduction or planetary gearing in conjunction with a variable speed electric motor may be utilized to facilitate desired speed and torque output.

The electric motor may be a modular component of a bottom hole assembly or be utilized stand alone. The electric motor may be utilized to enlarge or ream the wellbore with or without drill string rotation as typically supplied from surface equipment. The electric motor may have multiple configurations to facilitate adaptability to desired rock cutting/destruction mechanisms. These configurations may include laser drilling or laser drill bit assist such as is described by Sinha et al. in SPE/IADC 102017, Polycrystalline Diamond Compact (PDC) cutting structures on fixed cutter bits, roller cone bits, pulsed electric rock drilling apparatus like the one described in US 2010/000790 by Tetra, or other rock destruction devices. In fact, the presence of the power to power and electric motor lends itself naturally to being able to supply the necessary power to drive a laser for drilling or bit drilling assistance.

Rotation for the cutting assembly may be provided by the rotation of the drill string from surface equipment or any of the following: a modular motor assembly fitted to a separate rotating cutting assembly or an integral assembly where rotation for the cutting assembly can be provided by a motor assembly or motor assemblies fitted within the single assembly. The cutting structure on the cutting assembly may have the depth of cut (ultimate diameter) powered by an independent electric motor controlling ramps or pistons. When cutting rotation is not desired the cutter assembly cutting structures may be retracted and the modular motor assembly can be commanded to shut down and if necessary the ability to rotate can be locked. Reaming could be optimized by allow the individual cylindrical reaming cutting assemblies to have power to rotate on their own arbors.

Referring now to FIGS. 12A-12F, FIGS. 12A-12F depict various steerable BHA stack ups in accordance to certain embodiments of the present disclosure.

Figure 12A:
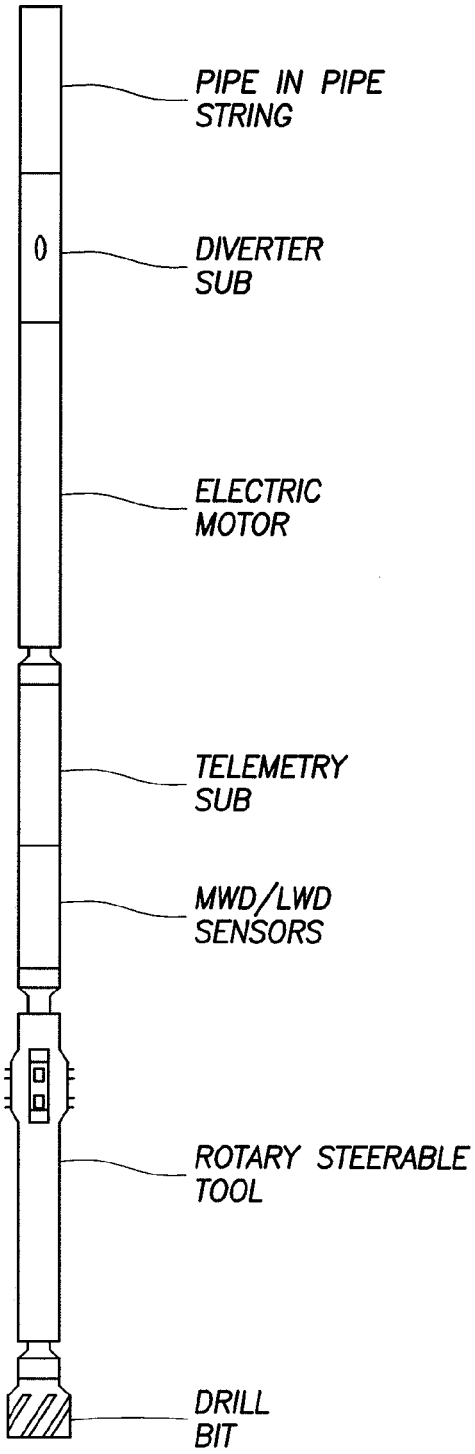
FIGS. 12A-12F depict various rotary steerable BHA stack ups in accordance to certain embodiments of the present disclosure While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

In one embodiment, steerable BHA stack up may be configured in accordance to FIG. 12A. In this scenario a conventional BHA is rotated by the electric motor which eventually drives the shaft of a rotary steerable tool. In other embodiments, the electric motor may be fitted with a through motor telemetry system that jumps communications from the non-rotating stator to the drive shaft through the use of a slip ring or an inductive coupler such as 2 coils or 2 torriods. Such techniques are described in US Patent Application Publication No. 2010/0224356 and U.S. Pat. No. 6,392,561. Other short hop telemetry techniques exist and are known to those skilled in the art.

Figure 12B:
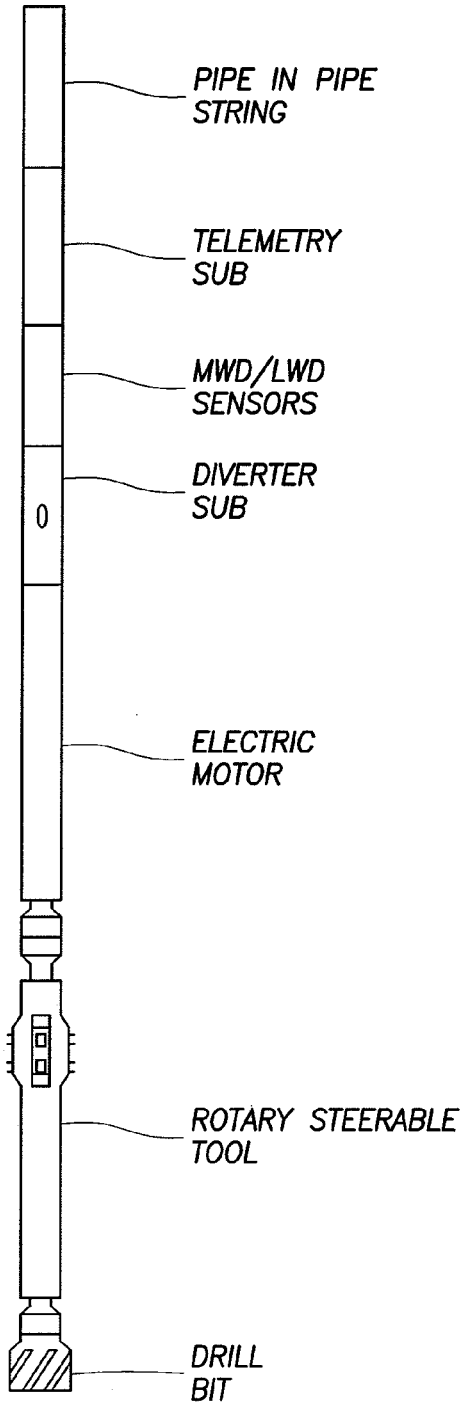

In one embodiment, a rotary steerable BHA stack up may be configured in accordance to FIG. 12B. In this embodiment, the MWD/LWD may be moved up above the electric motor. Sensors may be mounted in outsets rather than inserts, meaning they are attached from the side of the tool rather than inserted into the end of the tool and slide into position and covered over by protective hatches or sleeves as needed. The center bore of the string maintains the center pipe for managing return flow. In this manner the MWD supports both flow paths (up and down) inside its confines. The MWD/LWD sensors are arranged to permit the flow through various means such as maintaining the two inner flow paths as 2 concentric pipes and mounting the MWD/LWD components in external radial positions to these flow path as is shown in FIG. 12*f*. Alternately the diverter sub can be placed above the MWD then the electric motor allowing for a conventional MWD to be used, however a means for connecting the electrical power to the lower motor is required and would require a cable or other insulated conductor to be run from the upper diverter assembly, through the MWD/LWD section to the power input section on top of the electric motor.

Figure 12C:
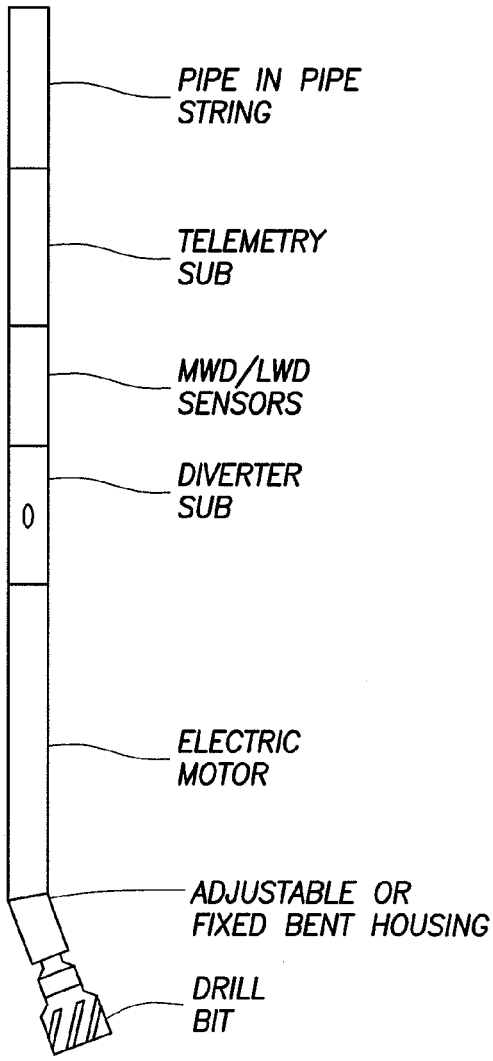

In one embodiment, a rotary steerable BHA stack up may be configured in accordance to FIG. 12C. In this embodiment, the electric motor may have a bent housing assembly attached to it using an internal coupling or torsion rod to facility the transfer or torque from the upper shaft to the lower shaft. Since large amounts of torque are available from the motor this type of set up offers many advantages over PDM designs. As discussed earlier the axial bearing can be positioned above or below the bent sub. It is preferable to mount the axial bearing above the bent sub however in order to shorten the bend to bit distance. The bent sub can be fixed, adjustable or down hole adjustable.

Figure 12D:
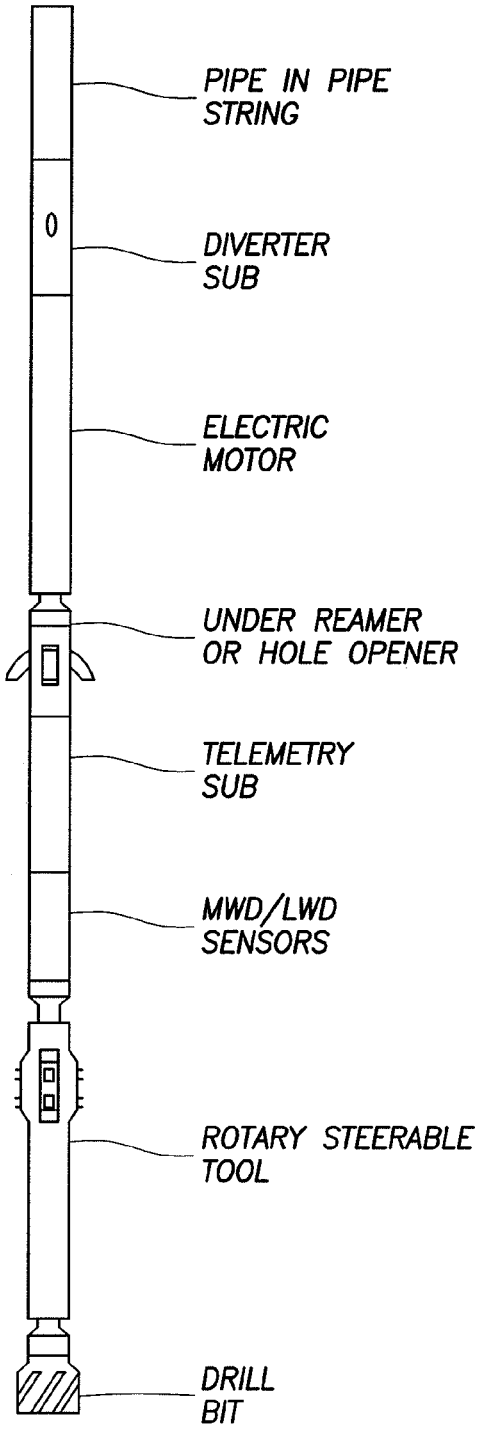

In one embodiment, a steerable BHA stack up may be configured in accordance to FIG. 12D. In this embodiment, the electric motor may provide power to an under reamer or a hole opener and drive a rotor steerable assembly. In this case both cutting structures are rotated by the electric motor.

Figure 12E:
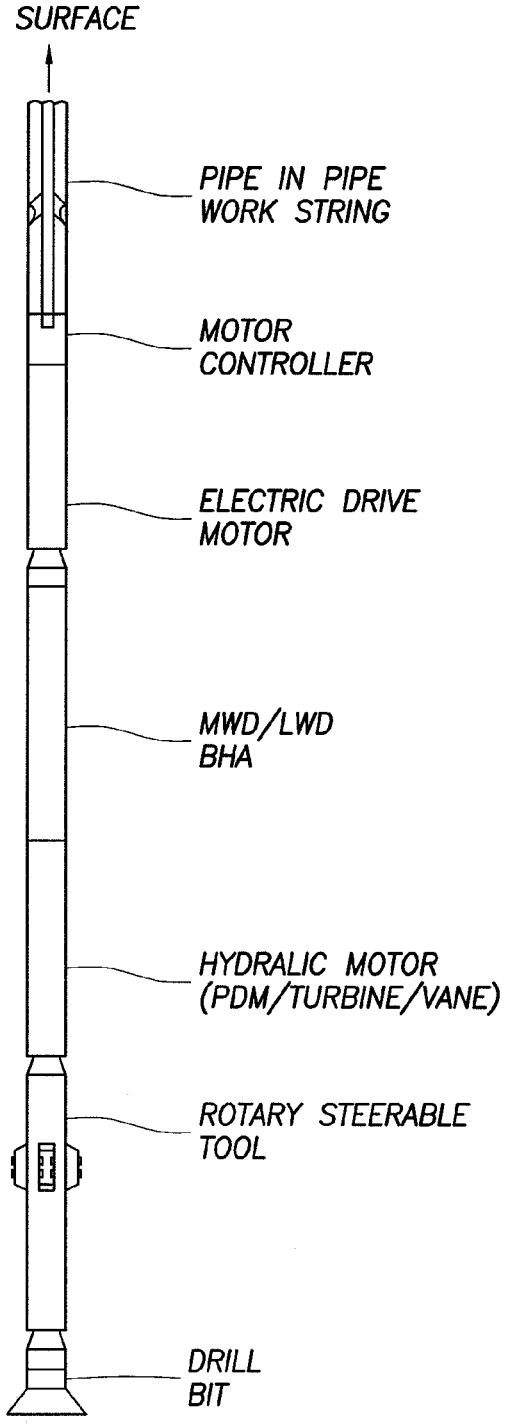
Figure 12F:
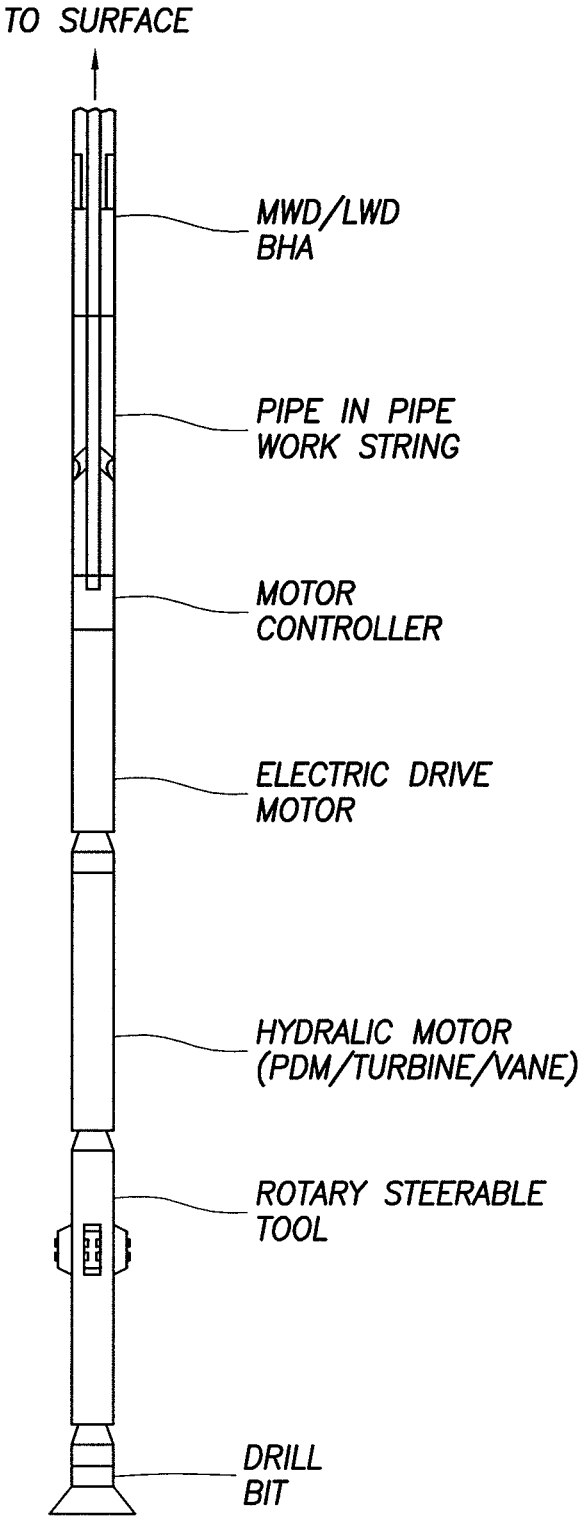

In one embodiment, a rotary steerable BHA stack up may be configured in accordance to FIG. 12E. This configuration allows for a conventional MWD/LWD to be utilized and an optional hydraulic motor is optionally inserted below the MWD/LWD to harness additional power to drive the bit. Such dual use of both electric and hydraulic power from the surface to create torque could be utilized in such a configuration to maximize torque to the bit for the given available power.

In one embodiment, a rotary steerable BHA stack up may be configured in accordance to FIG. 12F. FIG. 12*e* can be modified by positioning the MWD/LWD above the diverter as yet another example.

Other configurations are apparent in light of this disclosure by simply moving these modules around and interconnecting them as required for hydraulic, electric power and communications needs.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A pipe in pipe electric motor assembly comprising:

a drilling string comprising an inner pipe and an outer pipe, wherein the inner pipe and the outer pipe transmit a direct current power along the drilling string;

an electric motor controller electrically coupled to the inner pipe and the outer pipe, wherein the electric motor controller is positioned downhole, wherein the electric motor controller converts the direct current power to an alternating current;

an electric motor coupled to the electric motor controller, wherein the electric motor is provided with the alternating current of the at least one phase by the electric motor controller; and wherein the electric motor controller alters any two phases of the alternating current to change the direction of rotation of a rotor of the electric motor.

2. The pipe in pipe electric motor assembly of claim 1, wherein at least one of the inner pipe or the outer pipe is coated with an insulating material.

3. The pipe in pipe electric motor assembly of claim 2, wherein the insulating material comprises a dielectric material.

4. The pipe in pipe electric motor assembly of claim 3, wherein the dielectric material comprises at least one material selected from the group consisting of a polyimide, a high strength toughened fluoropolymer, nylon, teflon, and a ceramic coating.

5. The pipe in pipe electric motor assembly of claim 1, further comprising a drive shaft.

6. The pipe in pipe electric motor assembly of claim 5, wherein the drive shaft comprises a drive shaft magnet.

7. The pipe in pipe electric motor assembly of claim 1, wherein the electric motor is coupled to a drill bit.

8. A method of providing power to an electric motor comprising:

providing a pipe in pipe electric motor assembly comprising:

a drilling string comprising an inner pipe and an outer pipe, wherein the inner pipe and the outer pipe transmit a direct current power along the drilling string;

an electric motor controller electrically coupled to the inner pipe and the outer pipe, wherein the electric motor controller is positioned downhole, wherein the electric motor controller converts the direct current power to an alternating current, and an electric motor coupled to the electric motor controller; and providing the alternating current of the at least one phase to the electric motor by the electric motor controller, wherein the electric motor controller alters any two phases of the alternating current to change the direction of rotation of a rotor of the electric motor.

9. The method of claim 8, wherein at least one of the inner pipe or the outer pipe is coated with an insulating material.

10. The method of claim 9, wherein the insulating material comprises a dielectric material.

11. The method of claim 10, wherein the dielectric material comprises at least one material selected from the group consisting of a polyimide, a high strength toughened fluoropolymer, nylon, teflon, and a ceramic coating.

12. The method of claim 8, wherein the pipe in pipe electric motor assembly further comprises a drive shaft.

13. The method of claim 12, wherein the drive shaft comprises a drive shaft magnet.

14. The method of claim 8, wherein the electric motor is coupled to a drill bit.

15. A method of drilling a wellbore in a subterranean formation comprising:

providing a pipe in pipe electric motor assembly comprising:

a drilling string comprising an inner pipe and an outer pipe, wherein the inner pipe and the outer pipe transmit a direct current power along the drilling string;

an electric motor controller electrically coupled to the inner pipe and the outer pipe, wherein the electric motor controller is positioned downhole, wherein the electric motor controller converts the direct current power to an alternating current;

an electric motor coupled to the electric motor controller; and a drill bit, wherein the electric motor is provided with the alternating current by the electric motor controller;

providing the alternating current of the at least one phase to the electric motor to generate rotational power, wherein the electric motor controller alters any two phases of the alternating current to change the direction of rotation of a rotor of the electric motor; and applying the rotational power to the drill bit.

16. The method of claim 15, wherein at least one of the inner pipe or the outer pipe is coated with an insulating material.

17. The method of claim 16, wherein the insulating material comprises a dielectric material.

18. The method of claim 17, wherein the dielectric material comprises at least one material selected from the group consisting of a polyimide, a high strength toughened fluoropolymer, nylon, teflon, and a ceramic coating.

19. The method of claim 15, wherein the pipe in pipe electric motor assembly further comprises a drive shaft.

20. The method of claim 19, wherein the drive shaft comprises a drive shaft magnet.

* * * * *